US006824364B2

(12) United States Patent
Ross et al.

(10) Patent No.: US 6,824,364 B2
(45) Date of Patent: Nov. 30, 2004

(54) MASTER/SLAVE PUMP ASSEMBLY EMPLOYING DIAPHRAGM PUMP

(75) Inventors: Timothy P. Ross, Kannapolis, NC (US); Robbie L. Cecil, High Point, NC (US)

(73) Assignee: Rimcraft Technologies, Inc., Kannapolis, NC (US)

( * ) Notice: Subject to any disclaimer, the term of this patent is extended or adjusted under 35 U.S.C. 154(b) by 68 days.

(21) Appl. No.: 10/247,969

(22) Filed: Sep. 20, 2002

(65) Prior Publication Data

US 2004/0057853 A1 Mar. 25, 2004

(51) Int. Cl.[7] ..... F04B 23/08; F04B 23/04

(52) U.S. Cl. ..... 417/199.1; 417/382; 417/426

(58) Field of Search ..... 417/118, 129, 417/199.1, 204, 269, 382, 383, 374, 379, 387, 388, 392, 393, 395, 397, 413, 425, 499, 426, 502, 503; 222/1, 129, 134, 135, 136, 137, 255, 309

(56) References Cited

U.S. PATENT DOCUMENTS 2,894,732 A * 7/1959 Taber et al. ..... 366/143
2,946,488 A * 7/1960 Kraft ..... 222/134
3,171,721 A * 3/1965 Strathearn et al. ..... 422/133
4,312,463 A 1/1982 Daby
4,505,405 A 3/1985 Kelly et al.
4,509,903 A * 4/1985 Fram ..... 417/464
4,705,461 A * 11/1987 Clements ..... 417/387
4,830,586 A 5/1989 Herter et al.
4,936,753 A 6/1990 Kozumplik, Jr. et al.
5,133,483 A 7/1992 Buckles
5,279,504 A 1/1994 Williams
5,334,003 A 8/1994 Gardner et al.
5,391,060 A 2/1995 Kozumplik, Jr. et al.
5,607,290 A 3/1997 Duncan
5,894,784 A 4/1999 Bobbitt, III et al.
5,934,886 A 8/1999 Bushnell
6,015,268 A 1/2000 Hetherington
6,145,430 A 11/2000 Able et al.
6,168,387 B1 1/2001 Able et al.
6,251,293 B1 * 6/2001 Snodgrass et al. ..... 210/767
6,280,149 B1 * 8/2001 Able et al. ..... 417/63
6,327,960 B1 12/2001 Heimueller et al.

FOREIGN PATENT DOCUMENTS

GB 2257481 A * 1/1993 ..... F04B/43/06

* cited by examiner

*Primary Examiner*—Charles G. Freay
(74) *Attorney, Agent, or Firm*—Robert W. Pitts

(57) ABSTRACT

A master/slave pump assembly employs a dual diaphragm pump as the master pump. An abrasive fluid, such as a resin containing abrasive particles, can be pumped by the dual diaphragm pump without the damage that would result from exposure of seals to the abrasive fluid. The slave pump, which can pump a catalyst or other secondary fluid, is driven in response to movement of the diaphragms and the shaft connecting the two diaphragms. A force or a signal dependent upon the actual mass flow rate of the primary fluid, can be communicated hydraulically or electrically to the slave pump, regardless of viscosity or environmental factors. An adjustable linkage is employed to alter the ratio of the mass flow rates of the two fluids.

19 Claims, 5 Drawing Sheets

MASTER/SLAVE PUMP ASSEMBLY EMPLOYING DIAPHRAGM PUMP

BACKGROUND OF THE INVENTION

1. Field of the Invention

This invention relates to a master/slave pump assembly for use in precision metering, multiple component pumping systems in which an auxiliary or slave pump operates in unison with a main or master pump. This invention is also related to dual diaphragm pumps in which a flexible diaphragms pump fluid through a pumping chamber as the diaphragms and a shaft or rod on which they mounted are reciprocated in response to an actuating force, such as a pneumatic force.

2. Description of the Prior Art

U.S. Pat. No. 4,830,586 discloses a double acting diaphragm or dual diaphragm pump that includes two flexible pumping diaphragms connected by a shaft. The diaphragms and the shaft reciprocate in response to alternative pressurization of chambers between the two pumping diaphragms Supplemental pressure chambers in combination with an additional supplemental diaphragm act with the primary pressure chambers and the pumping diaphragms to effectively increase the pressure acting on the fluid within the pumping chambers. This pump also includes an inlet manifold and an outlet manifold communicating with pumping chambers on the outer side of each diaphragm. Ball check valves are provided at the entrance and exit of each pumping chamber.

The ARO 1" High Pressure 3:1 Ratio (Metallic) Diaphragm Pump is one version of a dual diaphragm pump commercially available from Ingersoll-Rand Company This commercial dual diaphragm pump possesses some of the characteristics of the dual diaphragm pump disclosed in U.S. Pat. No. 4,830,586. This commercially available pump does not appear to include the supplemental diaphragm, but it does include pistons connected to the two pumping diaphragms.

U.S. Pat. No. 6,280,149 discloses an air drive dual diaphragm pump including a linear displacement sensor generating an output voltage proportional to the relative position of a shaft or connecting rod extending between the two diaphragms. Various factors, including the dynamics of the fluid being pumped affect the rate of reciprocation of the diaphragms and the shaft connecting them. For more viscous fluids, the reciprocating rod and diaphragm will reciprocate more slowly for a given air pressure, and the output mass flow rate of viscous fluid will be reduced. One embodiment of an active feedback apparatus includes an inductance coil surrounding ferromagnetic material in the rod. The position of the rod is then dependent upon the inductance of the coil In another embodiment, a linear displacement sensor is disposed next to a diametrically tapered portion and the output voltage potential depends upon the relative position between the linear displacement sensor and the tapered portion. The instantaneous position, velocity and acceleration of the connecting rod can thus be determined. Volumetric displacement of the diaphragm pump and thus be monitored and actual dispensing/metering control, stall prevention, noise control and over travel control are intended benefits of the active feedback An electronic feedback system of this type does not appear to have been previously employed as part of a master/slave pump assembly.

It does not appear that dual diaphragm pumps have been previously employed in a precision metering, multiple component pumping systems in which an auxiliary or slave pump operates in unison with a main or master pump. Such pumps are used to deliver multiple fluids in a metered amount for precise mixing One use of such master/slave pump assemblies is to deliver a resin and a metered amount of catalyst to a mixing zone or mixing element. A precise ratio between the mass flow rate of resin and of catalyst is required for proper operation of such systems. In the fiberglass reinforced product industry, it is essential that the proper ration of catalyst to resin be maintained for proper curing of the finished product. This ratio is not fixed for all applications. Temperature, humidity and product variations can require a different ratio of catalyst to resin. Thus some adjustment of the relative mass flow rates is necessary for any practical assembly. One prior approach that is discussed in U.S. Pat. No. 6,015,268 employs an adjustable linkage between master pump and the smaller volume slave pump. Adjustments can be made by changing the connection between a linking arm and a slave pump drive arm to shorten or lengthen the pumping link arm. U.S. Pat. No. 6,015,268 discloses an adjustable assembly in which an auxiliary or slave pump is coupled to the drive shaft of a master pump by an adjustable rack and pinion gear system. The slave pump is linked to the master pump by a ball joint attached to a yoke of an oscillating quadrant arm coupled to the pinion gear shaft. The amount of secondary or auxiliary fluid, such as a catalyst, is adjusted by adjusting the working length of the oscillating arm. In that patent, an air driven actuator or motor drives coaxial pistons in opposed displacement pumps. It is necessary to seal the pistons relative to their respective cylinders. When the primary fluid, such as a resin used in a fiberglass reinforced product, includes a significant number of abrasive particles or fillers, the life of these seals can be relatively short. The trend is to include more and more additives in resins for a number of reasons, including flammability and other safety related requirements. Therefore, it becomes more and more difficult to operate those pumps for an extended period without replacing damaged seals.

Other prior art master/slave pump assemblies have exposed and separate air motors and fluid or pumping sections that are connected by tie rods at a junction point between the two components. These other prior art assemblies are similar to that shown in U.S. Pat. No. 6,280,149 in that the air motor and the fluid section have an exposed junction point between them where a linkage to a slave pump can be attached. Diaphragm pumps do not have a similar exposed and available attachment point for connecting a linkage between the diaphragm master pump and a slave pump. Attempts have been made to extend the connecting shaft or rod in a diaphragm pump through the fluid pumping section and through the end caps on the diaphragm pump forming one side of the pumping chambers to the exterior of the pump, where a connection can be made to a slave pump However, this approach requires introduction of seals where the extended shaft or rod enters and exits the fluid pumping chamber. These seals, which would normally comprise O-rings would be exposed to the pumped fluid. When an abrasive fluid or a fluid including abrasive particles, fillers or fibers is pumped, such seals are damaged or will rapidly deteriorate resulting in excessive maintenance and down time for such pumps. With the invention described herein no additional seals will be exposed to an abrasive fluid.

SUMMARY OF THE INVENTION

This invention comprises an apparatus for pumping plural component fluids at proportional mass flow rates. The apparatus or assembly includes a master pump including a diaphragm for pumping a primary fluid, such as a resin, at a first mass flow rate dependent upon reciprocation of the diaphragm. An intermediate actuator, responsive to movement of the diaphragm, generates an output force dependent upon movement of the diaphragm. This intermediate actuator can be hydraulically or electrically connected, directly or indirectly connected to the diaphragm, or the response can be generated in other ways. The output force from the intermediate actuator drives a slave pump. The slave pump pumps a secondary fluid, such as a catalyst, at a mass flow rate dependent upon reciprocation of the diaphragm. In this manner the primary and secondary fluids can be pumped separately at proportional mass flow rates dependent upon reciprocation of the diaphragm in the master pump. This invention is especially suited for pumping a primary fluid containing abrasive particles, because unlike conventional pumps with elastomeric seals in the flow path of the primary fluid, the diaphragms would not be subject to significant damage or deterioration as a result of exposure to the abrasive particles. The ratio of the primary fluid mass flow rate to the secondary fluid mass flow rate can be altered by an adjustable linkage connecting the intermediate actuator to the slave pump.

This invention also comprises a metering pump assembly for pumping two fluids at flow rates in a ratio independent of the viscosity of the two fluids. This metering pump assembly includes a diaphragm master pump for pumping a first fluid and a slave pump for pumping the second fluid The diaphragm pump includes pump actuation means, such as a pneumatic actuator, and a pumping chamber on at least one side of a diaphragm. A fluid tight chamber is located between the diaphragm and the pump actuation means. In the preferred embodiment, a dual diaphragm pump is employed A hydraulic fluid is disposed in the fluid tight chamber. A hydraulic line communicating between the fluid tight chamber and one side of a slave pump actuating piston so that movement of the diaphragm is communicated to the slave pump actuating piston by the hydraulic fluid. The second pump is driven by movement of the actuating piston. The flow rate of second fluid is therefore dependent upon movement of the diaphragm, which pumps the first fluid, and is independent of the viscosity of the first fluid.

BRIEF DESCRIPTION OF THE DRAWINGS

FIG. 3B is a continuation of FIG. 3A.

DETAILED DESCRIPTION OF THE PREFERRED EMBODIMENTS

A master/slave pump assembly comprising the preferred and representative embodiment of this invention is especially useful in delivering the following examples of fluid systems in a fixed ratio or proportion:

Unsaturated polyester resins

Vinylester resins

Epoxy resins

Catalyzed contact cements

Water based catalyzed contact cements, among others

This list of components with which this master/slave pump assembly can be used is not intended to be all inclusive, but this assembly is especially suited for use with a primary fluid or resin that may contain fillers or particles, which may be abrasive and which might tend to damage elastomeric or other seals that are used in conventional pumps that have heretofore been used in multiple component pumping and metering assemblies.

A master/slave pump assembly according to this invention includes a master pump 2 and a slave pump 60. A primary fluid, such as a resin containing abrasive fillers or fibers would be pumped through the master pump 2 The slave pump 60, which functions in unison with the master pump 2, would pump a secondary fluid, such as a catalyst, to a mixing zone, such as a spray head for dispensing a fiberglass mixture prior to curing or solidification.

Of course the fluid components, such as the resin and the catalyst, should be pumped in the proper proportions to the mixing zone to insure formation of a satisfactory end product. Therefore, the mass flow rate of fluid through the slave pump 60, which is typically the smaller of the two pumps, should always be dependent upon the mass flow rate through the master pump 2. For a specific application, the ratio of the mass flow rate of the secondary fluid relative to the mass flow rate of the primary fluid should be constant, even if the mass flow rate of the primary fluid should fluctuate during operation of the master/slave pumping or metering assembly. Fluctuations could be due to changes in temperature or pressure or other environmental conditions; to variations in the force driving the master pump, such as changes in air pressure for a pneumatically actuated pump; or to variations in the mass flow rate of material entering the master or primary pump 2. Although this ratio of secondary fluid to primary fluid should remain constant for a specific application, any master/slave pump assembly used in such applications should be suitable for use with different constituent material, which will require different proportions of primary and secondary fluids. Therefore the master/slave pump assembly must be adjustable, but must also be capable of stable operation when adjusted for a specific mixture or application. An adjustable or variable mechanical proportional linkage 70 located between the master pump 2 and the slave pump 60 permits such adjustment.

Figure 1:
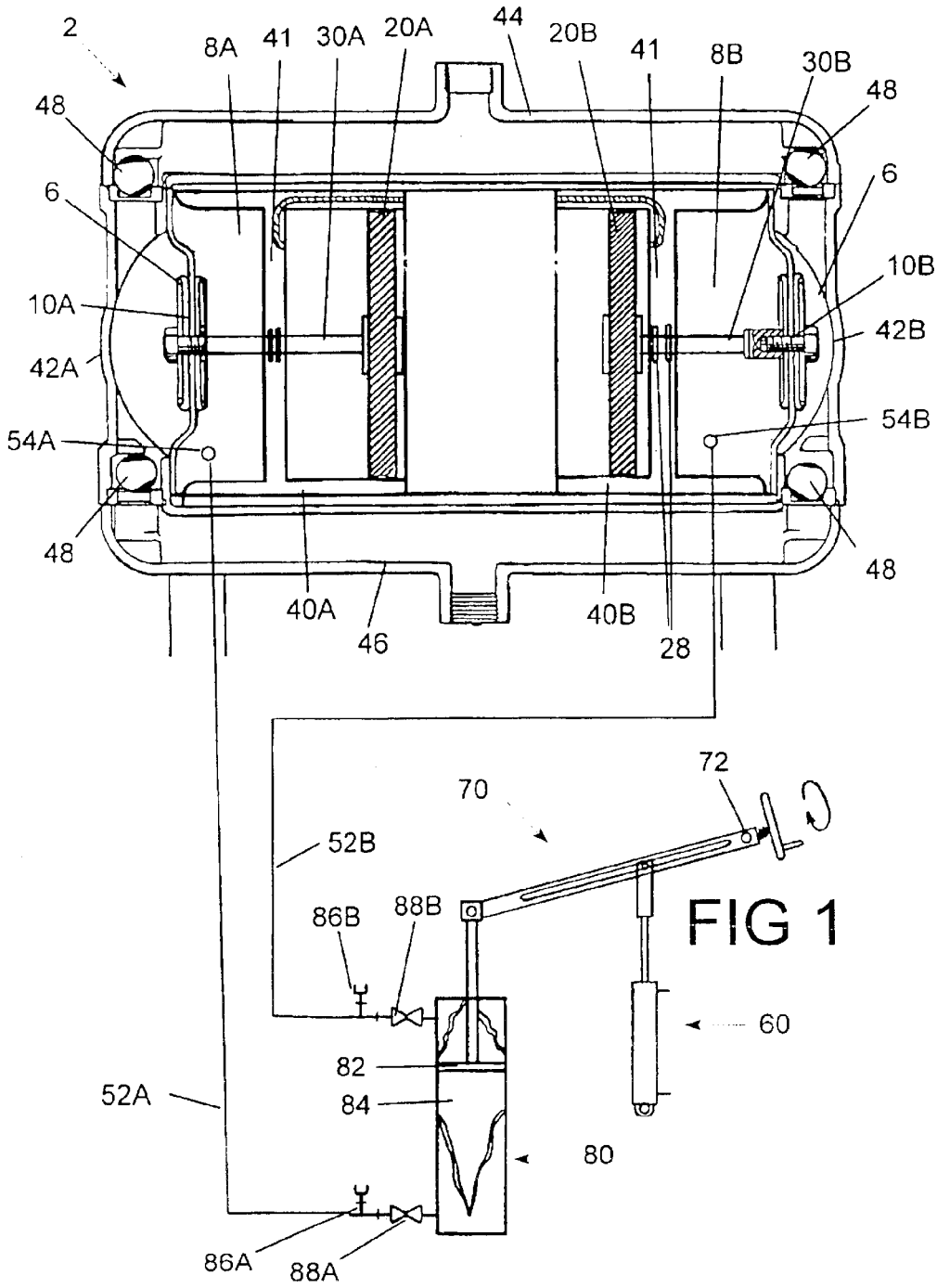
FIG. 1 is a view of a master/slave pumping system using a dual diaphragm pump to pump a primary fluid and a slave pump dependent upon the dual diaphragm pump.
Figure 2:
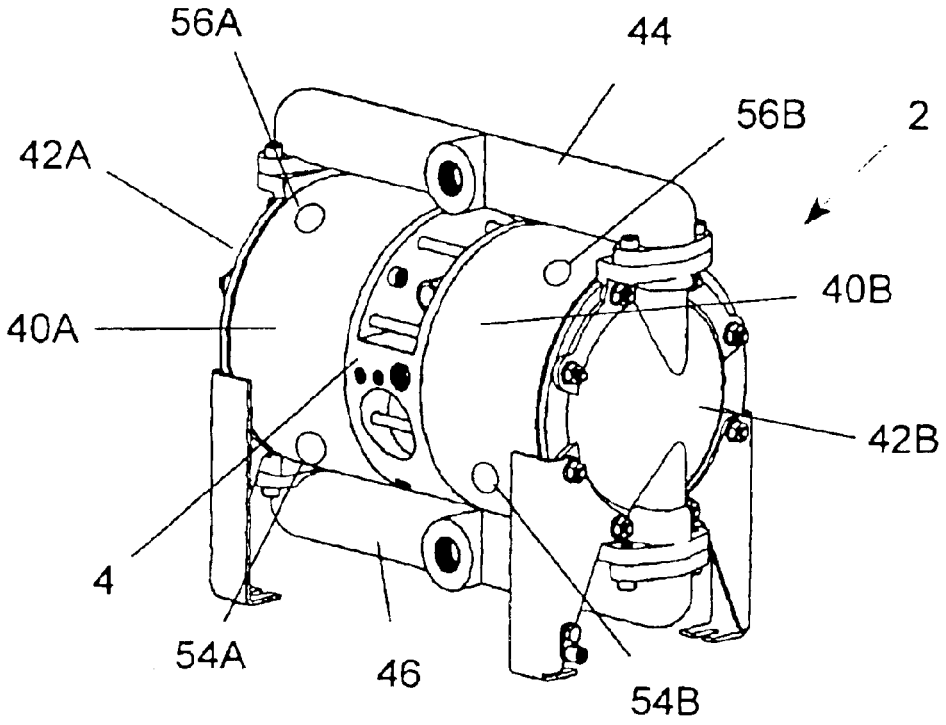
FIG. 2 is a view of a dual diaphragm pump of the type that can be used in the system of FIG. 1.

Two alternative means for insuring that the slave pump 60 will be dependent upon the master pump 2 will be discussed with reference to this invention. The first approach is illustrated in FIGS. 1–3 A & B. This first embodiment employs a hydraulic fluid 50 and an intermediate fluid actuator 80 connected between the master pump 2 and the slave pump 60. The hydraulic fluid 50 transmits a force to the intermediate fluid actuator 80, which in turn transmits a force through the adjustable linkage 70 to the slave pump 60. The force transmitted by this hydraulic means is dependent upon the mass flow rate through the master pump 2, and therefore the mass flow rate through the second or slave pump 60 will be dependent upon the mass flow rate of the primary fluid. The second approach employs an electrical sensor 90 to monitor the movement of the actuating pistons 20A and 20B or the rods or shafts 30A & 30B, whose reciprocation cause the primary fluid to be pumped through the master pump 2. The electrical signal sensed by sensor 90 will in turn be input to a servomechanism 94, which will then transmit a force to the secondary or slave pump 60. Since this force will be proportional to the mass flow rate of the primary fluid, caused by reciprocation of pistons 20A and 20B, and shafts 30A & 30B, the mass flow rate of the secondary fluid will be proportional to the mass flow rate of the primary fluid.

Figure 3A:
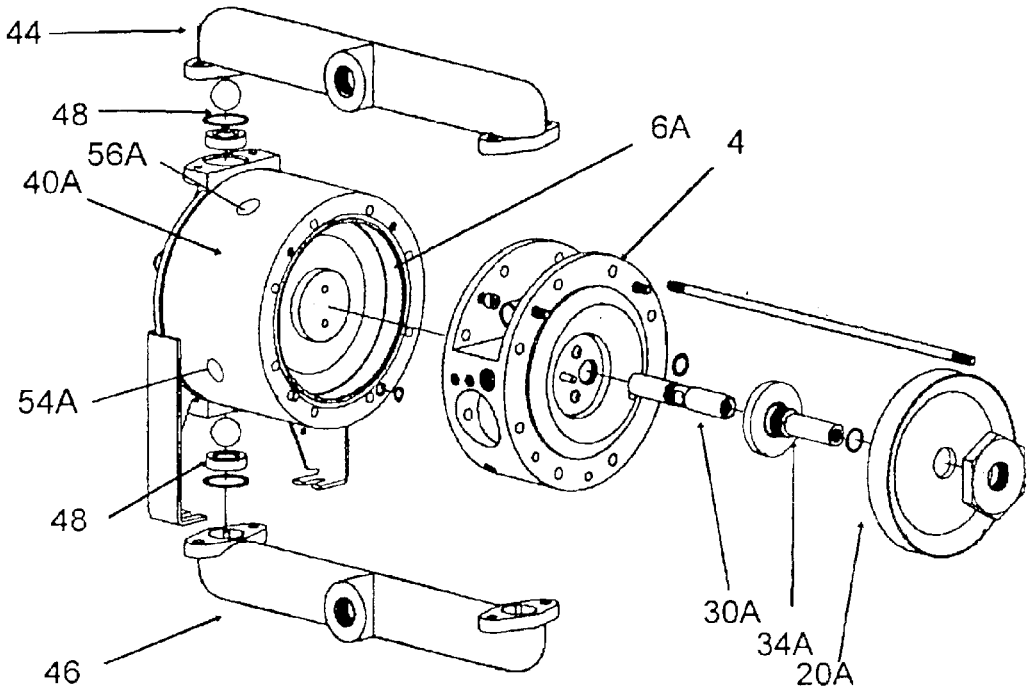
FIGS. 3A and 3B are exploded views showing the components of the dual diaphragm pump of FIG. 2.
Figure 3B:
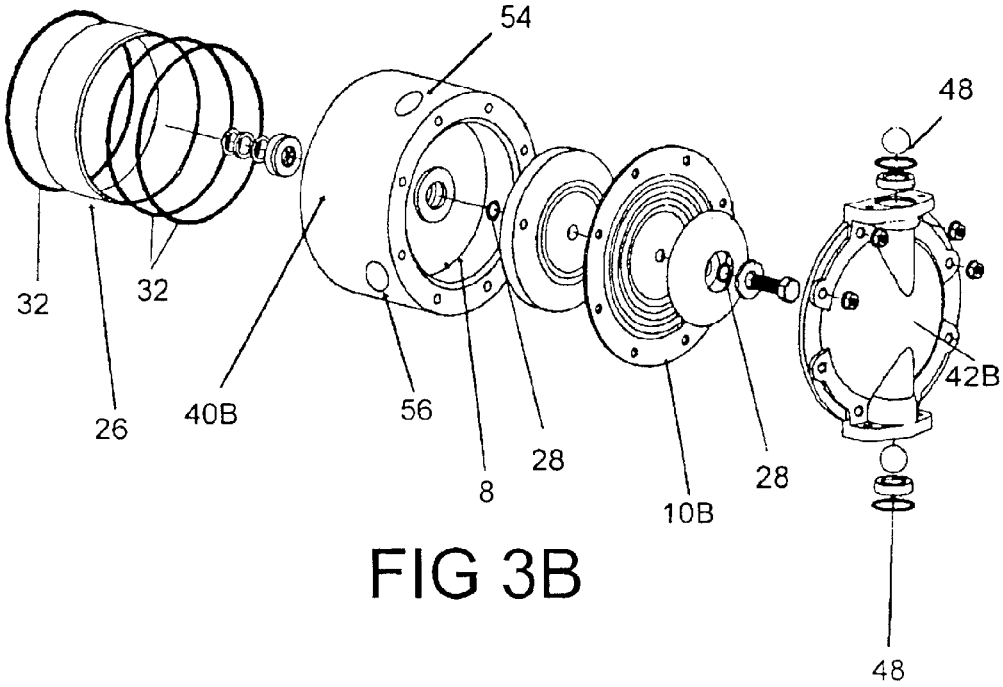

For both the hydraulic and the electrical means of controlling operation of the slave pump in response to the operation of the master pump, or for that matter other means, the master pump 2 comprises a diaphragm pump In the preferred embodiment a dual diaphragm pump having two reciprocating fluid pumping diaphragms 10A and 10B located on opposite sides of a pump actuator 4 is employed. In the preferred embodiments, a modified ARO 1" High Pressure Diaphragm Pump—3.1 Fluid to Air Ratio (Metallic) Pump, manufactured and sold by Ingersoll-Rand Company as PH10 style pumps, is used as the master dual diaphragm pump 2. This dual diaphragm pump 2 is pneumatically actuated by an air motor 4 of conventional construction, which includes spool valves that cause reciprocation of the diaphragms 10A & 10B to alternatively pump fluid through pumping fluid chambers 6A and 6B located at either end of the dual diaphragm pump 2. The air motor 4 operates in the same manner as for conventional applications of the basic diaphragm pump, which is used in a modified form in this invention. Furthermore, it is not necessary that the master pump 2 be pneumatically actuated. For these reasons, additional description of the air motor 4 is not necessary for a full understanding of this invention. Although the pump actuation means described in U.S. Pat. No. 4,830,586 is not the same as that employed in the dual diaphragm pump used in the preferred embodiment, a pump of the type shown in that patent could be employed and therefore the disclosure of U.S. Pat. No. 4,830,586 is incorporated herein by reference. The two diaphragms 10A and 10B adjacent opposite ends of pump 2 are respectively connected to pistons 20A and 20B by a rods or shafts 30A and 30B so that the diaphragms 10A and 10B reciprocate with the pistons 20A and 20B. The rods or shafts 30A and 30B is connected to the center of the circular diaphragms 10A and 10B. As seen in FIGS. 3A and 3B, the outer periphery of each diaphragm 10A and 10B is bolted to the outwardly facing edges of the adjacent cylindrical pump outer body section 40A and 40B. Each diaphragm 10A and 10B is flexible so that, as best seen in FIG. 1, the diaphragms flex inwardly and outwardly as the pistons 20A, 20B and shafts 30A, 30B reciprocate in opposite directions relative to the stationary body sections 40A and 40B.

The air motor 4, which is connected through the rod assemblies 30A and 30B to the pistons 20A and 20B, first applies a force tending to move piston 20A outwardly bringing the other piston 20B with it. When the pistons 20A and 20B have shifted to one extent of their travel, a valve means in the air motor 4 shifts and the pressure differential between opposite sides of the pistons 20A and 20B also shifts to drive the piston assembly in the opposite direction. As the pistons 20A and 20B shift first in one direction and then in another, the diaphragms 10A and 10B flex to first open a pumping chamber 6 on one end of the pump and close the pumping chamber 6 adjacent the other end of the diaphragm pump 2. As either diaphragm 10A and 10B closes the adjacent pumping chamber 6, the ball check valve 48 connecting the inlet manifold 44 with the closing pumping chamber 6 and opens the ball check valve 48 communicating with the outlet manifold 46. Thus fluid is force out of the closing pumping chamber. As one pumping chamber 6 is closing, the pumping chamber 6 at the opposite end of the pump 2 is opening. The ball check valve 48 between the inlet manifold and the opening pumping chamber 6 is opening, drawing fluid from the inlet manifold 44 into the opening pumping chamber. At the same time the outlet ball check valve in the opening pumping chamber 6 is closing, allowing that pumping chamber to fill as the primary pumped fluid is being expelled from the opposite pumping chamber.

Only the ball check valves 48 and the diaphragms 10A and 10B move as fluid is pumped through the pumping chambers. 6. The end caps 42A and 42B, forming the outer wall of each pumping chamber 6 are bolted to the respective stationary body sections 40A and 40B. Pumping chamber volume changes are due entirely to the flexing diaphragms 10A and 10B. Since the diaphragms 10A and 10B are one piece members and since they are bolted between adjacent body sections 40A and 40B and end caps 42A and 42B, no seals, which may be subject to damage by abrasive particles are required for the reciprocating diaphragms 10A and 10B. The ball and ball seats in the ball check valves 48 are exposed to any abrasive fibers in the pumped fluid, but these components do not slide relative to each other and do not require the use of an elastomeric o-ring seal of the type used in a conventional pump in which a piston acts directly on the pumped fluid.

The actuating pistons 20A and 20B do slide relative to the cylinders 26A and 26B and O-rings 28A and 28B do seal this interface These actuating pistons 20A and 28B, as well as the O-rings 28A and 18B are not exposed to the pumped fluid or to any abrasive particles contained within that primary fluid or resin. The actuating pistons 20A and 20B are located on opposite sides of a bulkhead 41 is each body section 40A and 40B from the diaphragms 10A and 10B. The rods or shafts 30A and 30B do extend through holes in the center of the bulkhead 41, but O-rings seals 32 on opposite sides of the bulkhead seal the space on one side of the bulkhead 41 from the other side. These O-ring seals 32 are also located on the side of the diaphragms 10A and 10B that is not exposed to the primary pumped fluid, which may contain abrasive particles.

Closed cavities 8A and 8B are formed between the bulkhead 41 of each body section 40A and 40B and the adjacent diaphragms 10A and 10B in a conventional dual diaphragm pump on which the master pump 2 is based. In the first embodiment of this invention, these cavities 8A and 8B are filled with a hydraulic fluid, such as 10 weight hydraulic oil. In the preferred embodiment two ports are provided in each of the closed cavities 8A and 8B. First ports 54A and 54B are connected to a linear fluid actuator 80 through hydraulic lines 52A and 52B. Fill ports 86A and 86B are located adjacent to the fluid actuator 80 with isolation valves 88A and 88B located between the actuator 80 and the fill ports 86A and 86B. To fill the hydraulic fluid chambers 8A and 8B, the isolation valves 88A and 88B are closed and the fill ports 86A and 86*b* are opened. The vent ports 56A and 56B are also open. Hydraulic fluid is added through the fill ports 86A and 86B and air in the chambers 8A and 8B is vented through open ports 56A and 56B. When the hydraulic chambers 8A and 8B are full, the vent ports 56A and 56B are capped and the fill ports 86A and 86B are also capped. Isolation valves 88A and 88B are then opened so fluid communication is established between the hydraulic chambers 8A and 8B and the fluid actuator 80.

In the preferred embodiment, the other ends of these hydraulic lines 52A and 52B are connected to an intermediate hydraulic actuator 80 including an actuator piston 82 in a cylinder 84. Hydraulic line connections for lines 52A and 52B are located on opposite sides of the actuator piston 82. One hydraulic line 52A is connected to master pump hydraulic chamber 8A and the other hydraulic line 52B connects the opposite side of the actuator piston 82 with the other master pump hydraulic chamber 8B. Thus as the diaphragms 10A and 10B are shifted, hydraulic fluid will be pumped first to one side of the actuator piston 82 and then to the other side, causing actuator piston 82 to cycle at the same frequency as the diaphragms 10A and 10B. Thus the movement of the actuator piston 82 will depend directly upon the mass flow rate of primary fluid pumped through the master pump 2. The output of the actuator piston 82 can then be connected through linkage 70 to drive the slave pump 60. Linkage 70 pivots about axis 72. Adjustment of the linkage connection of the slave pump 60 relative to the pivot point 72 will alter the amount of secondary fluid pumped by the slave pump 60 during each cycle of the master dual diaphragm pump 2.

Linkage 70 is adjustable so that the stroke of the slave pump piston is dependent upon the relative adjustment of the linkage 70. When the linkage 70 is adjusted the ratio of the mass flow rate of the catalyst or second fluid pumped by the slave pump 60 relative to the mass flow rate of the resin or primary fluid pumped by dual diaphragm pump 2 is also changed. Adjustable linkages of this type are commonly used to adjust the proportion of primary to secondary fluids, and adjustable linkage 70 is substantially the same as those used in prior art master slave pumps. Typical ratios of primary to secondary fluids with which this master/slave pump assembly can be used range from 2:1 to 100:1.

Figure 4:
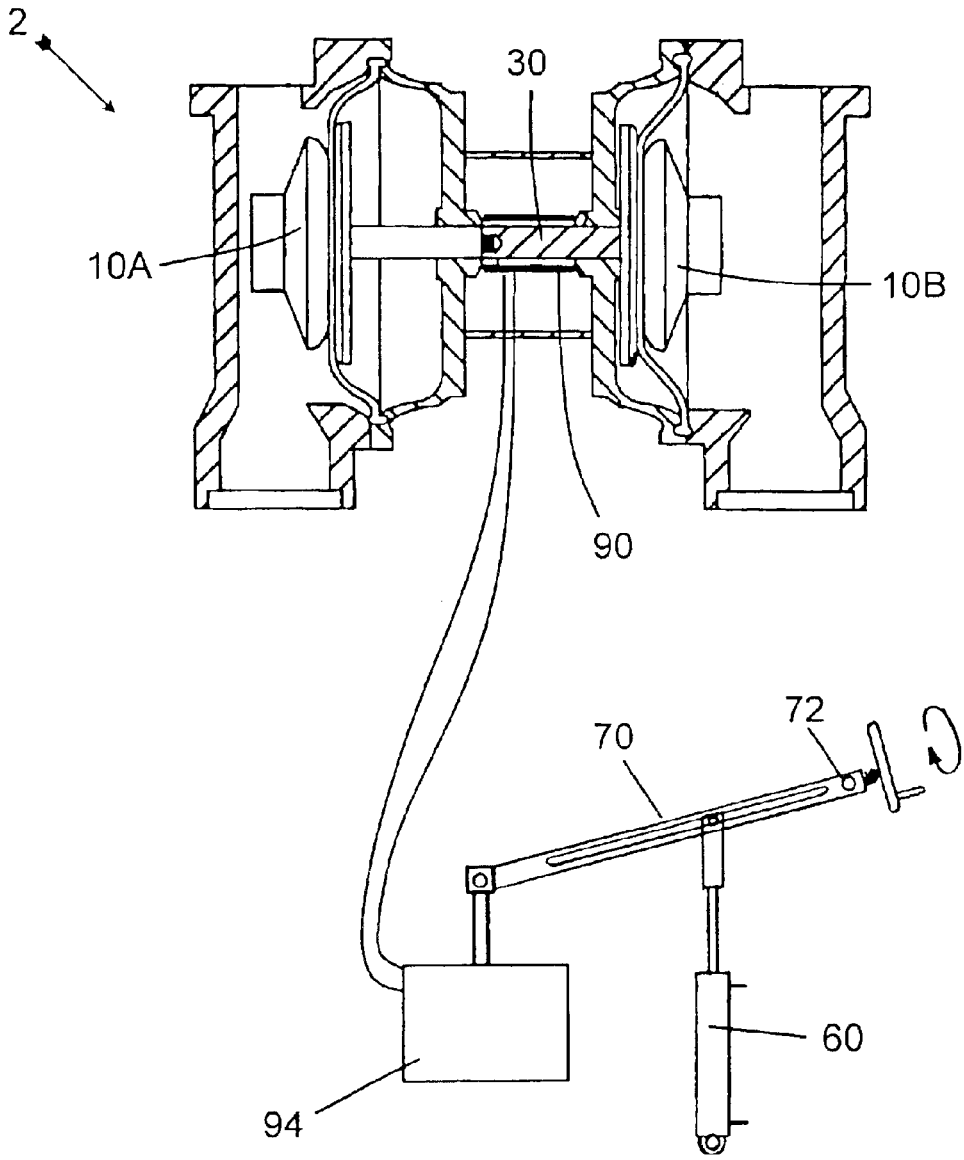
FIG. 4 is a view of an alternate embodiment in which an electrical sensor monitoring operation of the master pump is used to control the slave pump.

Although the embodiment of FIGS. 1–3A and 3B uses a hydraulic fluid to link the slave pump 60 to the master pump 2, other means can be employed. FIG. 4 shows that electrical sensing means, such as an inductance coil 90 can be used to sense the motion of the rods or shafts 30A and 30B connecting the diaphragms 10A and 10B to the air motor 4. U.S. Pat. No. 6,280,149, which is incorporated herein by reference, discloses the use of an inductance coil in this manner. That patent also discloses other electrical sensing means for detecting the movement of a shaft attached to diaphragms in a diaphragm pump. Since the motion of the either shaft 30A or shaft 30B is dependent upon the mass flow rate of the primary fluid actually pumped through a dual diaphragm pump, this signal can be used to control the slave pump 60 so that it will pump the corresponding proportional amount of secondary fluid. In the embodiment of FIG. 4, the signal derived from inductive coil 90 is input into a conventional servomechanism 92, which causes a linear actuator 94 to move in a manner dependent upon this input signal. The linear actuator 94 can then be attached to adjustable linkage 70 in the same manner as shown and discussed with respect to the hydraulic embodiment of FIG. 1.

The embodiments of FIGS. 1–4 are representative in nature and the instant invention could be implemented in other ways by those skilled in the art. The two basic embodiments depicted herein do however comprise cost effective means of implementing this invention. Although primarily intended for pumping relative viscous primary fluids containing abrasive fillers or particles, such as fiberglass resins, this invention could also be employed in transporting other multiple component systems. This invention is also not limited to use with the basic dual diaphragm pump described herein, and additional enhancements could also be made to this assembly. Therefore this invention is defined by the following claims and is not limited to the representative embodiments depicted herein.

We claim:

1. An apparatus for pumping plural component fluids at proportional mass flow rates comprising:

a master pump including a diaphragm for pumping a primary fluid at a first mass flow rate dependent upon reciprocation of the diaphragm;

an intermediate actuator responsive to movement of the diaphragm and comprising means for generating an output force dependent upon movement of the diaphragm; and a slave pump driven by the output force from the intermediate actuator to pump a secondary fluid am a mass flow rate dependent upon reciprocation of the diaphragm, so that primary and secondary fluids can be pumped separately at proportional mass flow rates dependent upon reciprocation of the diaphragm in the master pump;

the master pump comprises a dual diaphragm pump including two diaphragms mounted on a shaft and reciprocal in unison.

2. The apparatus of claim 1 wherein the intermediate actuator includes a linear reciprocal actuator.

3. The apparatus of claim 1 wherein the intermediate actuator comprises a piston driven by a hydraulic fluid, the hydraulic fluid being in communication with the diaphragm.

4. The apparatus of claim 1 wherein the intermediate actuator comprises a servomechanism controlled by an electrical signal dependent upon the position of the diaphragm.

5. The apparatus of claim 1 wherein an electrical signal dependent upon the position of the shaft provides an electrical signal for controlling the intermediate actuator.

6. The apparatus of claim 1 wherein a hydraulic fluid is confined in chambers on sides of the diaphragms opposite from sides of the diaphragms in contact with the primary fluid pumped through the master pump.

7. The apparatus of claim 1 including a variable mechanical proportional linkage between the intermediate actuator and the slave pump for changing the ratio of the mass flow rate of the secondary fluid relative to the mass flow rate of the primary fluid.

8. The apparatus of claim 1 comprising means for pumping a resin through the master pump and means for pumping a catalyst through the slave pump.

9. The apparatus of claim 8 wherein tho master pump comprises means for pumping a primary fluid containing abrasive particles contained therein on one side of the diaphragm, connection of the intermediate actuator being on an opposite side of the diaphragm from the side of the diaphragm exposed to the abrasive particles, so that connection of the intermediate actuator to the diaphragm does not include seals exposed to the primary fluid containing abrasive particles.

10. A master/slave pump assembly comprising a master pump for pumping a first fluid at a first fluid flow rate and a slave pump for pumping a second fluid at a second fluid flow rate, wherein the master pump includes a reciprocal shaft connected to a diaphragm to pump the first fluid, and wherein the force acting on the slave pump to pump the second fluid is dependent upon the position of the shaft in the master pump so that the fluid flow rate through the slave pump is proportional to the fluid flow rate through the master pump, the master slave numb assembly also including an adjustable linkage connected to the slave pump so that the ratio of the second fluid flow rate to the first fluid flow ratio is a function of the position of the adjustable linkage, the ratio of the second fluid flow rate to the first fluid flow rate remaining constant for each position of the adjustable linkage.

11. The master/slave pump assembly of claim 10 wherein the position of the shaft is sensed hydraulically.

12. The master/slave pump assembly of claim 10 wherein the position of the shaft is sensed electrically.

13. The master/slave pump assembly of claim 10 wherein the master pump comprises a dual diaphragm pump.

14. The master/slave pump assembly for claim 10 wherein the master pump is pneumatically actuated.

15. A metering pump assembly for pumping two fluids at flow rates in a ratio independent of the viscosity of the two fluids, the metering pump assembly comprising:

a diaphragm pump for pumping a first fluid;

a second pump for pumping the second fluid;

the diaphragm pump including pump actuation means, a pumping chamber on one side of a diaphragm, and a fluid tight chamber between the diaphragm and the pump actuation means;

an actuating piston;

the metering pump assembly further including hydraulic fluid in the fluid tight chamber with a hydraulic line communicating between the fluid tight chamber and one side of the actuating piston so that movement of the diaphragm is communicated to the actuating piston by the hydraulic fluid, the second pump being driven by movement of the actuating piston so that the flow rate of second fluid is dependent upon movement of the diaphragm, which pumps the first fluid, and is independent of the viscosity of the first fluid, wherein the diaphragms comprises a dual diaphragm pump, with diaphragms located on opposite sides of the pump actuation means and with two fluid tight chambers, each fluid tight chamber being located between an adjacent diaphragm and the pump actuation means, separate hydraulic lines extending between each fluid tight chamber communicating with opposite sides of the actuating piston.

16. The metering pump assembly of claim 15 including an adjustable linkage connecting the piston to the second pump, adjustment of the linkage changing the fluid flow ratio for the two fluids.

17. The metering pump assembly of claim 15 wherein the pump actuation means comprises pneumatic pump.

18. The metering pump assembly of claim 17 wherein a rod extends between the diaphragm and the pneumatic pump so that the pneumatic pump cycles the diaphragm, and a seal around the rod isolates the pneumatic pump from the fluid tight chamber.

19. An apparatus for pumping plural component fluids at proportional mass flow rates comprising:

a master pump including a diaphragm for pumping a primary fluid at a first mass flow rate dependent upon reciprocation of the diaphragm;

an intermediate actuator responsive to movement of the diaphragm and comprising means for generating an output force dependent upon movement of the diaphragm; and a slave pump driven by the output force from the intermediate actuator to pump a secondary fluid at a mass flow rate dependent upon reciprocation of the diaphragm, so that primary and secondary fluids can be pumped separately at proportional mass flow rates dependent upon reciprocation of the diaphragm in the master pump;

wherein the intermediate actuator comprises a servomechanism controlled by an electrical signal dependent upon the position of the diaphragm.

* * * * *